US006161236A

United States Patent [19]

Carroll

[11] Patent Number: 6,161,236

[45] Date of Patent: Dec. 19, 2000

[54] HEIGHT ADJUSTABLE BED AND METHOD OF OPERATION THEREOF

[76] Inventor: Timothy J. Carroll, 593 Upper Queen Street, London, Ontario, Canada, N6C 3T8

[21] Appl. No.: 09/061,906

[22] Filed: Apr. 17, 1998

Related U.S. Application Data

[60] Provisional application No. 60/044,068, Apr. 18, 1997.

[51] Int. Cl.[7] ..... A47B 7/02

[52] U.S. Cl. ..... 5/618; 5/611; 5/613

[58] Field of Search ..... 5/611, 612, 613, 5/616, 617, 618

[56] References Cited

U.S. PATENT DOCUMENTS

| | | | |
|---|---|---|---|
| 5,095,562 | 3/1992 | Alexander | 5/616 |
| 5,303,437 | 4/1994 | Hung | 5/611 X |
| 5,438,723 | 8/1995 | Carroll | 5/618 X |
| 5,682,631 | 11/1997 | Weismiller et al. | 5/618 |

*Primary Examiner*—Terry Lee Melius
*Assistant Examiner*—James M Hewitt
*Attorney, Agent, or Firm*—Daryl W. Schnurr

[57] ABSTRACT

A height adjustable bed on a floor provides a two stage continuous adjustment system and method of operation thereof. An upper frame is raised from a lowermost position to a maximum intermediate position with a first set of legs resting on the floor. The upper frame is further raised from the maximum intermediate position to an uppermost position with a second set of legs resting on the floor. The transition from the first set of legs to the second set of legs and vice-versa is smooth and continuous. The system is powered by a reversible electric motor. A much greater range of distance is achieved over previous height adjustable beds. The ratio of uppermost distance of the upper frame off the floor to the lowermost distance can be greater than 2.5. A third set of wheeled legs can be added for mobility when it is desired to move the bed.

16 Claims, 8 Drawing Sheets

4/8

8/9

HEIGHT ADJUSTABLE BED AND METHOD OF OPERATION THEREOF

This Appln. claims the benefit of U.S. Provisional No. 60/044,068 filed Apr. 18, 1997.

BACKGROUND OF THE INVENTION

1. Field of the Invention

This invention relates to a height adjustable bed that has two moveable sets of legs to raise or lower the bed in two continuous stages.

2. Description of the Prior Art

Height adjustable beds are known, but previous beds do not achieve the minimum height that can be achieved with the bed of the present invention. Previous beds often do not lower the bed sufficiently to enable patients to get into or out of the beds more easily and safely. In some jurisdictions, it is not permissible to have side guards locked in position on either side of the bed. It is therefore important to have the beds as close to the floor as possible so that if a patient does fall out of the bed, serious injury is very unlikely. The difficulty encountered with designing height adjustable beds is that when the minimum height is very low, the mechanism to raise and lower the bed will not fit under the bed.

Further, previous beds often do not achieve a ratio of the uppermost distance to the lowermost distance from the floor of greater than 2.5. Still further, previous beds that have a low minimum height often cannot be raised high enough to enable the use of under bed tables and patient lifting devices with the beds. Some previous height adjustable beds are too complex, too unstable or expensive to achieve widespread market acceptance.

SUMMARY OF THE INVENTION

It is an object of the present invention to provide a height adjustable bed that has a ratio of uppermost distance over lowermost distance from the floor much greater than 2.5. It is a further object of the present invention to provide a height adjustable bed that has an upper frame that can be lowered to less than eight inches and raised to a level of nearly twenty-two inches above a supporting surface by way of a two stage continuous movement.

It is still a further object of the present invention to provide a height adjustable bed that has two sets of legs, one set resting on the supporting surface during a first stage of movement and another set of legs resting on the supporting surface during a second stage of movement.

A height adjustable bed on a supporting surface has an upper frame with a first set of legs and a second set of legs indirectly connected thereto. The first set of legs is indirectly connected to said second set of legs and is moveable relative thereto. Control means is connected to control movement of the first and second set of legs and of the upper frame. The first set of legs rests on the supporting surface when the upper frame is in a first stage position ranging from a lowermost position to a maximum intermediate position. The second set of legs rests on the supporting surface when the upper frame is in a second stage position ranging from the maximum intermediate position to an uppermost position.

A method of operating a height adjustable bed with a two stage continuous adjustment system, said bed having an upper frame connected indirectly to a first set of legs and to a second set of legs with control means to control movement of the upper frame, first set of legs and second set of legs relative to one another. The method comprises commencing with the upper frame in a lowermost position with the first set of legs resting on the supporting surface, activating the control means to move the upper frame to a maximum intermediate position with the first set of legs and the second set of legs resting on the supporting surface, continuing to activate the control means to move the upper frame to the uppermost position with the second set of legs resting on the supporting surface.

DESCRIPTION OF A PREFERRED EMBODIMENT

Figure 1:
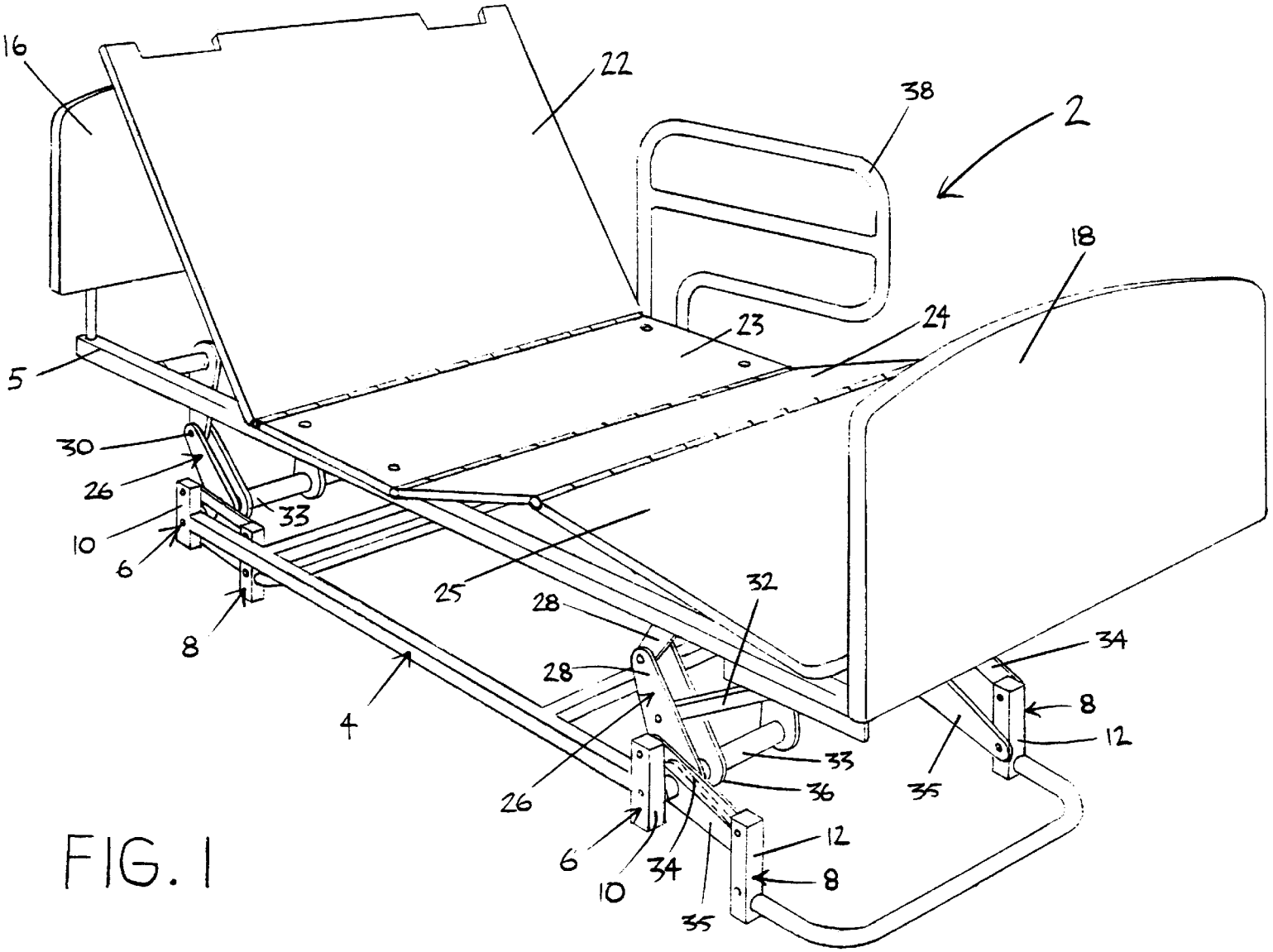
FIG. 1 is a prospective view of the bed in a partially raised position.

In FIG. 1, a bed 2 has a lower frame 4, an upper frame 5, a first set of legs 6 and a second set of legs 8. The first set of legs 6 has four first legs 10 (only two of which are shown in FIG. 1) and the second set of legs 8 has four second legs 12 (only three of which are shown in FIG. 1). The second legs 12 are resting on a supporting surface 14 and the first legs 10 are above the supporting surface. The upper frame is in a partially raised position in a second stage beyond a maximum intermediate position, but below an uppermost position. The first set of legs 6 are rigidly and directly connected to the lower frame 4. The lower frame 4 has a rectangular shape.

The bed 2 has a head 16, a foot 18 and an upper surface 20 comprised of a number of hinged panels 22, 23, 24, 25. There are two large panels 22, 25 located at each end of the bed and two smaller panels 23, 24 located between the large panels.

The first set of legs 6 is indirectly connected to the upper frame 5 by butterfly connectors 26 that extend from the lower frame 4 to the upper frame 5. The butterfly connectors 26 each have three elongated members 28 (one upper and two lower) connected at a pivot point 30. Control means (not shown in FIG. 1) controls the expansion/contraction movement of the butterfly connectors 26. A support 32 is pivotally connected to the two lower elongated members 28. The two lower elongated members are rigidly affixed to a cylindrical cross member 33 of the lower frame 4.

Higher and lower connecting arms 34, 35 respectively indirectly connect each of the first legs 10 to one of the corresponding second legs 12. The lower connecting arm 35 is rigidly affixed to one end 36 of a lower elongated member 28. An opposite end of the lower connecting arm 35 is pivotally connected to the second leg 12. The higher connecting arm 34 is pivotally connected between each of the first legs 10 and one of the corresponding second legs 12 to keep the legs 10, 12 vertically oriented as one set of legs pivots relative to the other set of legs. The legs 10, 12 and the connecting arms 34, 35 have the general shape of a parallelogram at all times as the upper frame is raised or lowered. The arms 34, 35 keep the second legs 12 vertical as they pivot relative to the first legs 10. A swing arm 38 can be used to retain a patient within the bed 2. The swing arm 38 is unrelated to the height adjustment of the bed and is therefore not further discussed.

Figure 2:
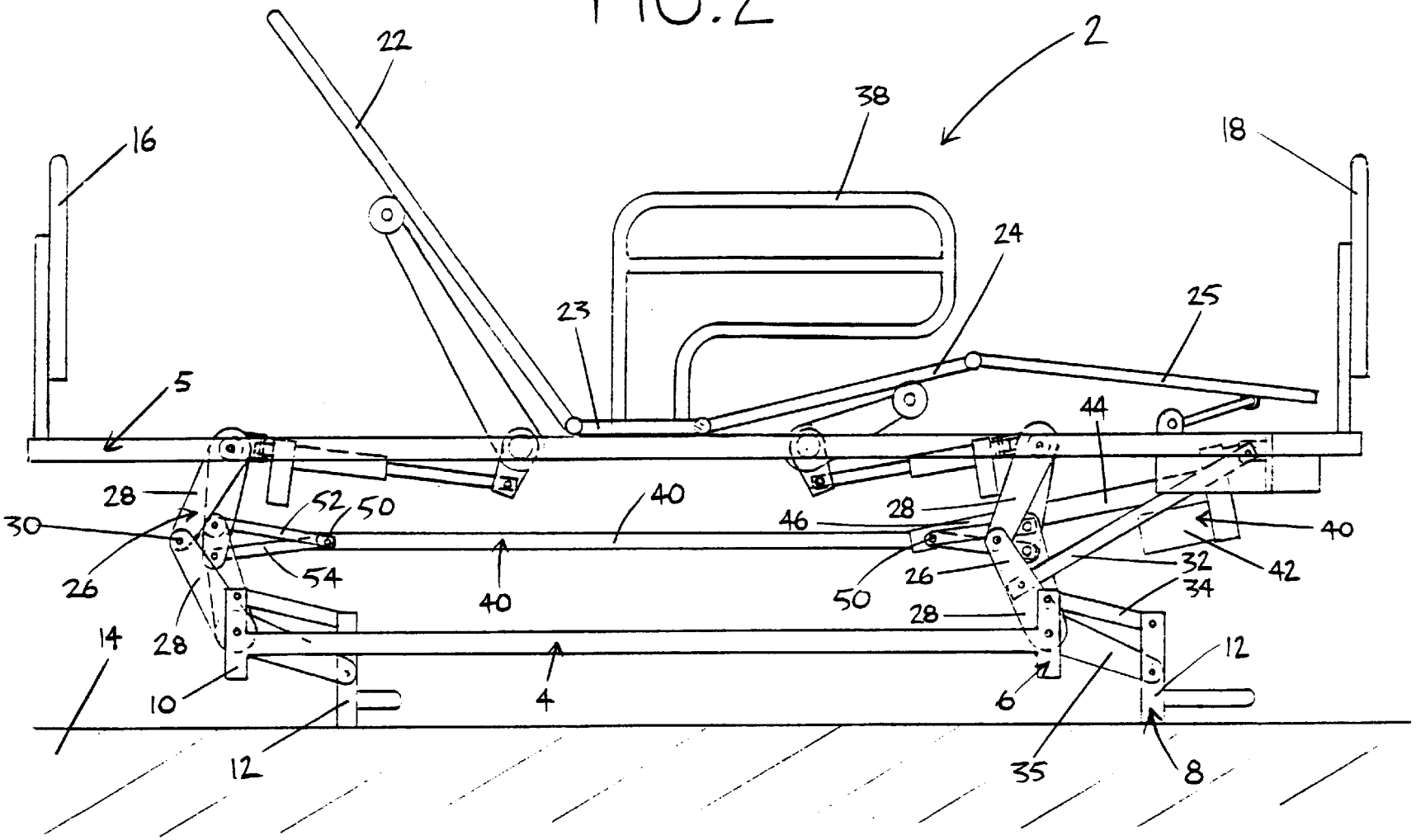
FIG. 2 is a side view of the bed in an uppermost position.

In FIG. 2, the bed 2 is shown in the uppermost position with the upper frame 5 a maximum distance above the supporting surface 14. In FIG. 2, those components that are identical to the components of FIG. 1 are described using the same reference numerals. Control means 40 includes a reversible electric motor 42 having an operating arm 44 that moves in or out depending on which direction the motor is running. The operating arm 44 has an extension 46 that is pivotally connected to a bar 48. The control means 40 is best shown in FIG. 5. The bar 48 extends between the lower frame 4 and the upper frame 5 and has two ends 50 with elongated connectors 52, 54 pivotally connected to each end 50 and being pivotally connected to pivot arms 55, 56 (best shown in FIGS. 4 and 5).

As the operating arm 44 moves outward from the motor 42, the bar 48 moves towards the head 16 of the bed 2. This movement causes the butterfly connectors 26 to contract, thereby lowering the upper frame 5 relative to the supporting surface 14. When the operating arm 44 moves inward toward the motor 42, the bar 48 is moved towards the foot of the bed 18 causing the butterfly connectors 26 to expand and the frame 5 to move upward. In FIG. 2, the frame 5 is shown in the uppermost position. It should be noted that the first set of legs 6 is in the air above the supporting surface 14 and the second set of legs 8 is resting on the supporting surface 14.

Figure 3:
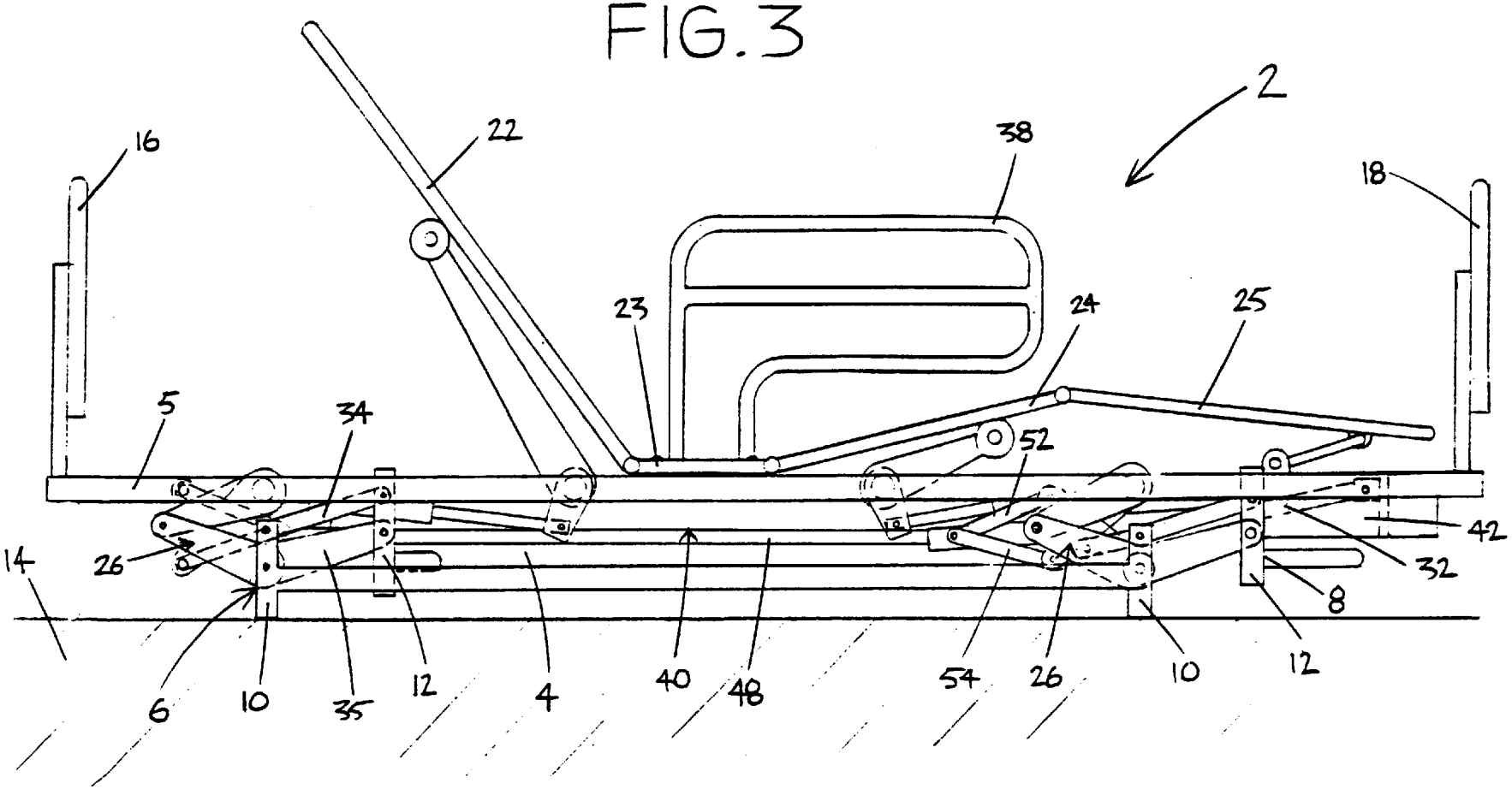
FIG. 3 is a side view of the bed in a lowermost position.

In FIG. 3, the frame 5 is shown in the lowermost position. Those components of FIG. 3 that are identical to the components of FIGS. 1 and 2 are described using the same reference numerals as those used in FIGS. 1 and 2. In FIG. 3, the bar 48 has moved toward the head 16 causing the butterfly connectors 26 to collapse completely so that the first set of legs 6 rests on the supporting surface or floor 14 and the second set of legs 8 are located in the air above the floor 14. The upper frame 5 is located just above the first set of legs 6.

The positions shown in FIGS. 2 and 3 are the extreme uppermost and lowermost positions respectively. In moving from the position shown in FIG. 2 to the position shown in FIG. 3 and vice-versa, there is an instant, when the upper frame 5 is located at the maximum intermediate position, where both the first set of legs 6 and the second set of legs 8 are in contact with the supporting surface (not shown). From this maximum intermediate position, if the motor remains activated to move the bar 48 further toward the foot 18, the second set of legs 8 will remain on the supporting surface 14 and the first set of legs 6 will lift off the supporting surface and ultimately the upper frame will reach the uppermost position shown in FIG. 2.

In FIGS. 2 and 3 there are, of course, four first legs 10 and four second legs 12, even though there are only two first legs and two second legs shown in these two drawings.

Figure 4:
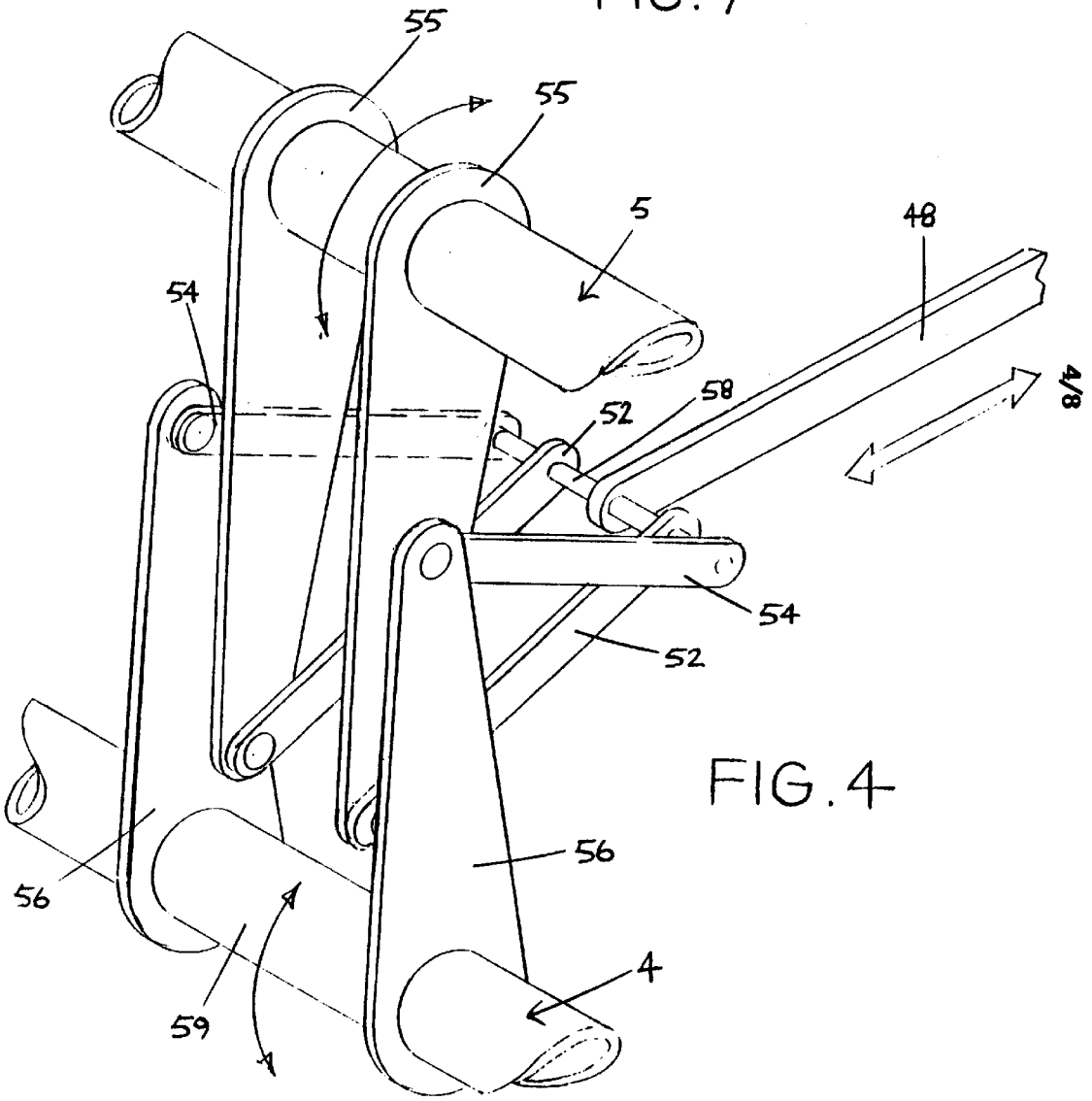
FIG. 4 is an enlarged prospective view of part of the control means.
Figure 5:
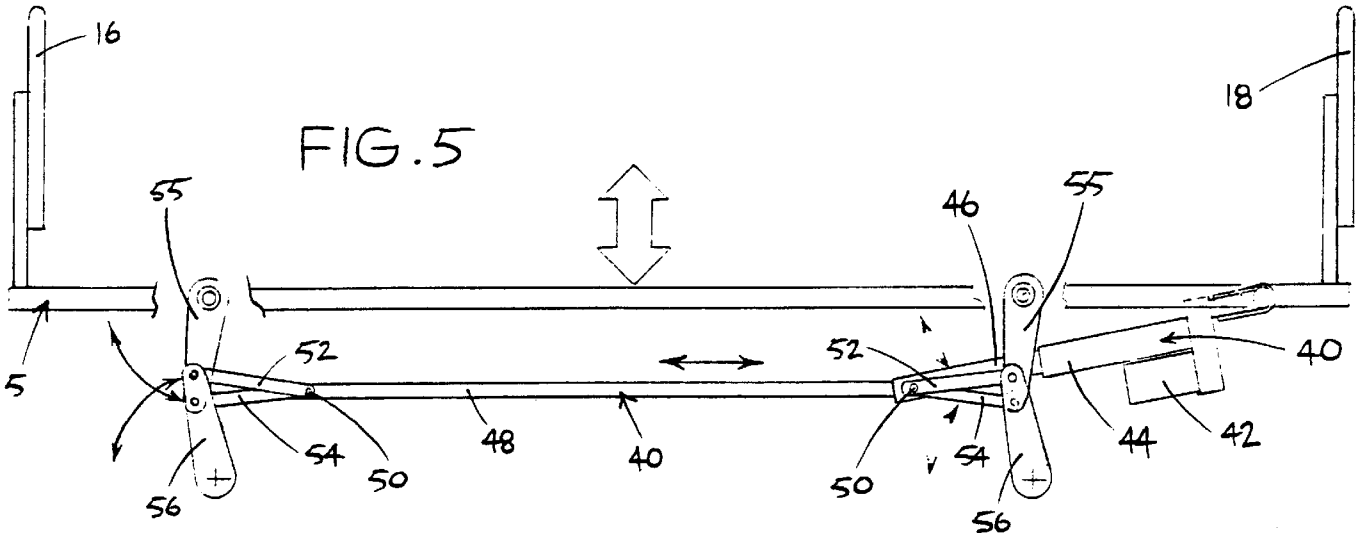
FIG. 5 is a schematic side view of the control means.

In FIG. 4, the linkage for the elongated connectors 52, 54 and the pivot arms 55,56 is shown. There is one of these linkages located at each end of the bed 2 as shown in FIGS. 2, 3 and 5. The bar 48 is pivotally connected to a rod 58. Elongated connectors 52 are pivotally connected between the rod 58 and a lower end of the pivot arms 55 that are rigidly affixed to a rotatable cross member 57 of the upper frame 5. The elongated connectors 54 are pivotally connected between the rod 58 and the upper end of the pivot arms 56 that are in turn rigidly affixed to a rotable cross member 59 of the lower frame 4. The movement of the bar 48 towards the pivot arms 55, 56 causes the pivot arms 55 to rotate clockwise and the cross member 57 of the upper frame 5 to rotate clockwise. Similarly, the same movement of the bar 48 causes the pivot arms 56 to rotate counterclockwise and to cause the cross member 59 of the lower frame 4 to rotate counterclockwise. The rotation of the cross member 57 clockwise and the cross member 59 counterclockwise from the view as shown in FIGS. 4, 2 and 3 causes the butterfly connectors 26 to collapse, thereby lowering the upper frame 5. When the bar 48 moves further away from the pivot arms 55, 56, the opposite occurs and the butterfly connectors 26 expand, thereby raising the upper frame 5.

Figure 6A:
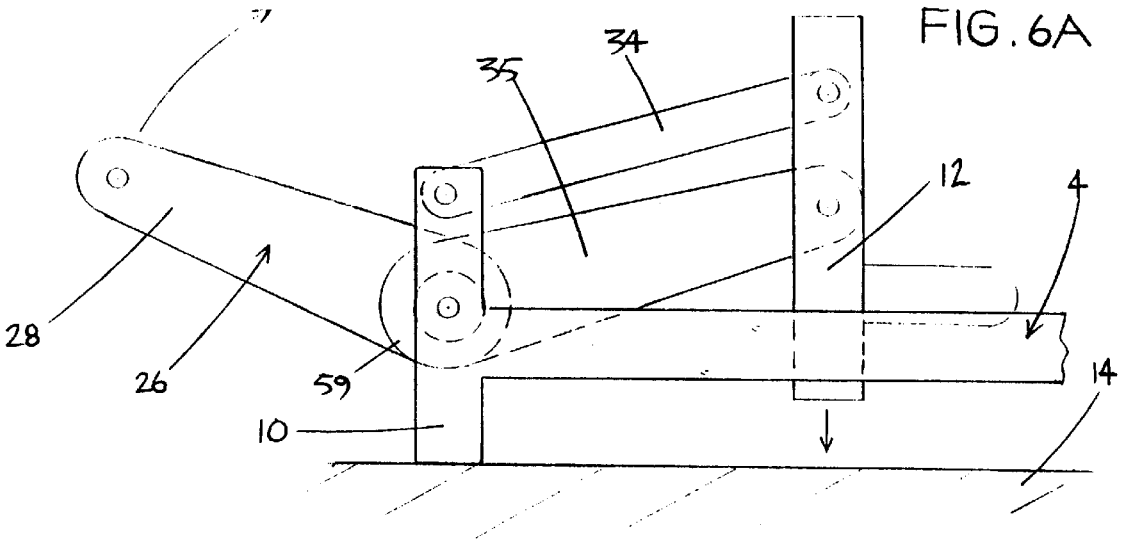
FIG. 6A is a partial side view of a first and second leg in the lowermost position.

In FIG. 6A, the first leg 10 rests on the supporting surface 14 and the second leg 12 is located above the supporting surface. The lower elongated member 28 of the butterfly connector 26 is rigidly connected to the rotable cross member 59 of the lower frame 4. The lower connecting arm 35 is rigidly connected to the same cross member 59 and pivotally connected to the second leg 12. The connecting arm 34 is pivotally connected at each end thereof to the first leg 10 and the second leg 12. As the cross member 59 rotates clockwise from the view shown in FIG. 6A, the arm 28 moves upward and the arm 35 moves downward, thereby causing the second leg 12 to move downward. The upper frame 5 (not shown in FIG. 6A) is at the lowermost position with the first leg 10 on the supporting surface 14 and the second leg 12 in the air (see also FIG. 3).

Figure 6B:
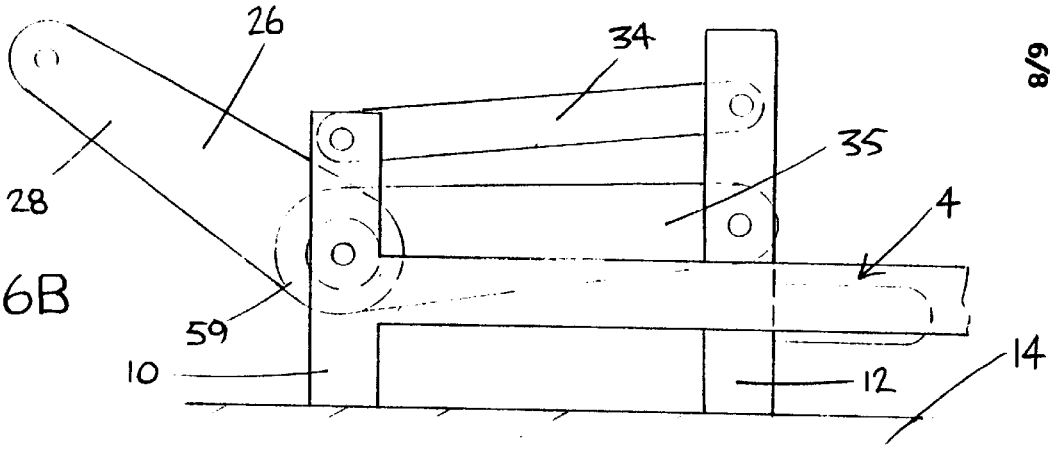
FIG. 6B is a partial side view of the first and second leg in a maximum intermediate position.

Ultimately, as shown in FIG. 6B, as the rotation of the cross member 59 continues in a clockwise manner, the second leg 12 rests on the supporting surface 14. The remaining components of FIG. 6B are identical to the components of FIG. 6A and the same reference numerals are used to describe these components. In the position shown in FIG. 6B, the upper frame (not shown in FIG. 6B) is at the maximum intermediate position as both the first leg 10 and second leg 12 are resting on the supporting surface 14.

Figure 6C:
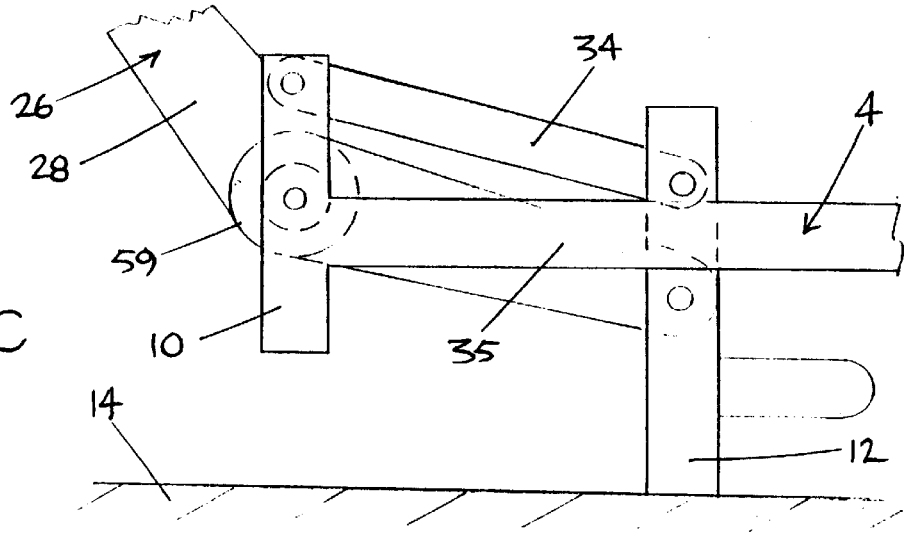
FIG. 6C is a partial side view of the first and second leg in an uppermost position.

Further clockwise rotation of the cross member 59 causes the first leg 10 to lift off the supporting surface 14 leaving the bed supported by the second leg 12 which rests on the supporting surface 14. In the position shown in FIG. 6C, the upper frame (not shown in FIG. 6C) is at the uppermost position relative to the supporting surface 14 (see also FIG. 2).

Figure 7:
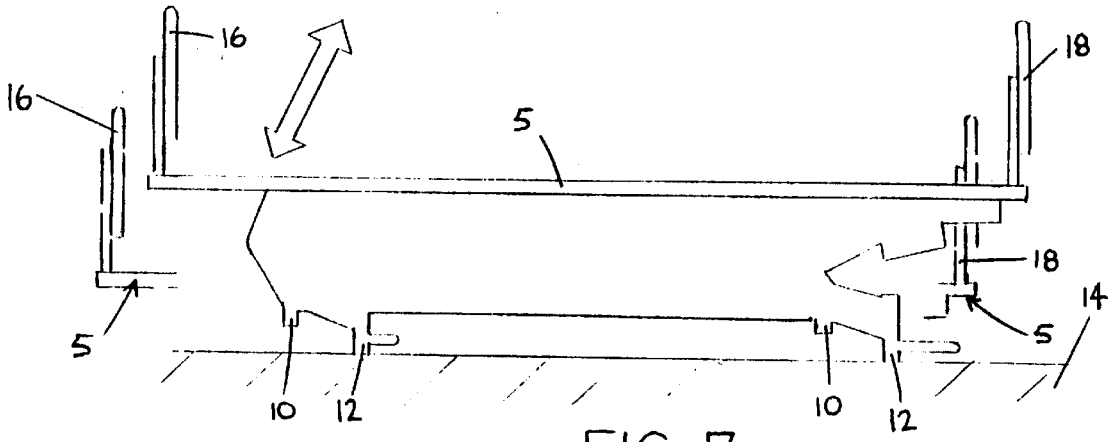
FIG. 7 is a schematic side view of the upper frame in the uppermost position with the upper frame shown in the lowermost position as well.

In FIG. 7, there is shown a schematic side view which shows the general outline of the first legs 10 and the second legs 12 when the upper frame 5 is in the uppermost position relative to the supporting surface 14. Those components that are identical to the components of the other drawings are described in FIG. 7 using the same reference numerals. It can be seen the that upper frame 5 is partially shown in its lowermost position as well so that the relative distance of movement of the upper frame 5 between the lowermost position and uppermost position can readily be observed.

Figure 8:
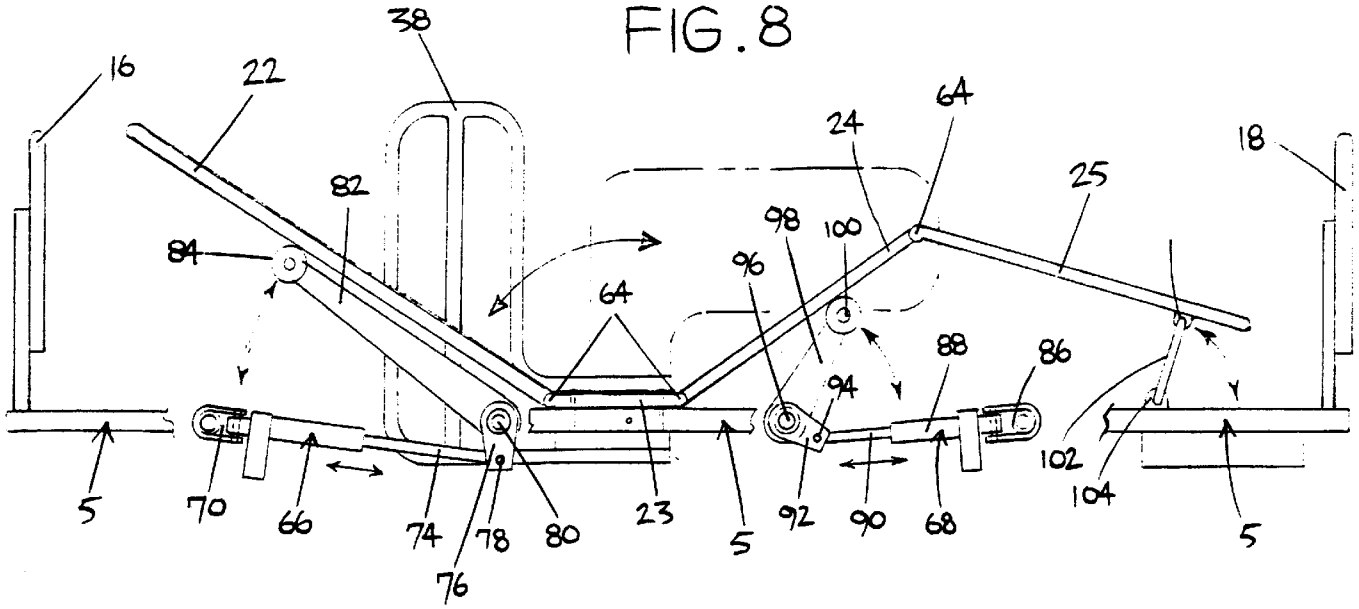
FIG. 8 is a side view of the upper frame, hinged panels and mechanism for raising a head and foot of the bed.

In FIG. 8, it can be seen that the upper frame 5 has panels 22, 23, 24, 25 located thereon, the panels being connected together by hinges 64. The same reference numerals are used to describe those components that are identical to the components described in the previous drawings. There are two conventional mechanisms 66, 68 that are used to raise or lower the panel 22 at the head 16 and the panels 24, 25 at the foot 18 respectively. The two mechanisms 66, 68 operate independently of one another.

The mechanism 66 is powered by a reversible electric motor 70 that has an operating arm 72 that moves inward or outward depending on which direction the motor is operating. The operating arm 72 has an extension 74 thereon that is pivotally connected to bracket 76 at pivot point 78. The bracket 76 is rigidly affixed to rotatable tubular member 80 that can be rotated clockwise and counterclockwise depending on the direction that the motor 70 is operating. A long arm 82 is rigidly connected to the tubular member 80. A free end of the long arm 82 has a roller 84 rotatably mounted thereon. As the operating arm 72 moves inward toward the motor 70, the extension 74 also moves inward pulling the bracket 76 toward the motor 70 and causing the tubular member 80 to rotate in a clockwise direction from the view shown in FIG. 8. The clockwise rotation of the tubular member 80 causes the long arm 82 to rotate upward, thus raising the panel 22. When the motor rotates in the opposite direction, the operating arm 72 and extension 74 cause the tubular member 80 to rotate in a counterclockwise direction, thus lowering the arm 82 and panel 22 to the point where the panel 22 lies flat on the upper frame 5.

The mechanism 68 is very similar to the mechanism 66 and has essentially the same components that will be described using different reference numerals so that the two mechanisms can be differentiated from one another. The mechanism 68 has a reversible electric motor 86 with an operating arm 88 and extension 90 pivotally connected to a bracket 92 at pivot point 94. The bracket 92 is rigidly affixed to tubular member 96 that is mounted so that it can rotate clockwise and counterclockwise depending on the direction that the motor 86 is operated. A long arm 98 is also rigidly affixed to the tubular member 96. The long arm 98 has a roller 100 rotatably supported at a free end thereof. Related to the movement of the mechanism 68, there is a short support 102 that is pivotally mounted at either end in brackets 104, 106. The bracket 104 is rigidly affixed to the upper frame 5 and the bracket 106 is rigidly affixed to a lower surface of the panel 25. In operation of the mechanism 68, when the motor 86 is operated to extend the operating arm 88, the extension 90 also extends away from the motor 86. This causes the bracket 92 to rotate the tubular member 96 clockwise from the view shown in FIG. 8. As the tubular member 96 rotates clockwise, the long arm 98 is also rotated clockwise causing the arm 98 to move closer to the upper frame 5, thus lowering the panel 24. As the panel 24 lowers, the panel 25 also lowers as does the short support 102. If the motor continues to extend the operating arm 88 and extension 90, the long arm 98 will ultimately lower the panels 24, 25 to the point where they lie flat on the upper frame 5. When the motor is rotated in the opposite direction to retract the operating arm 88 and extension 90 toward the motor 86, the tubular member 96 will rotate in a counterclockwise direction and the arm 98 and roller 100 will raise the panel 24. This is turn will cause the panel 25 to be raised and will pull the pivot arm 102 upward away from the upper frame 5.

With both mechanisms 66, 68, as an alternative, the tubular members 80, 96 could be mounted so that they remain fixed and do not rotate. Then, the bracket 76 and long arm 82 and the bracket 92 and long arm 98 could be rigidly affixed to one another and mounted so that they both pivot about the elongated members 80, 98 to raise or lower the panels 22 and 24, 25 respectively. The short support 102 does not have any motor but is pivoted by the force exerted from the panel 24 on the panel 25.

Figure 9:
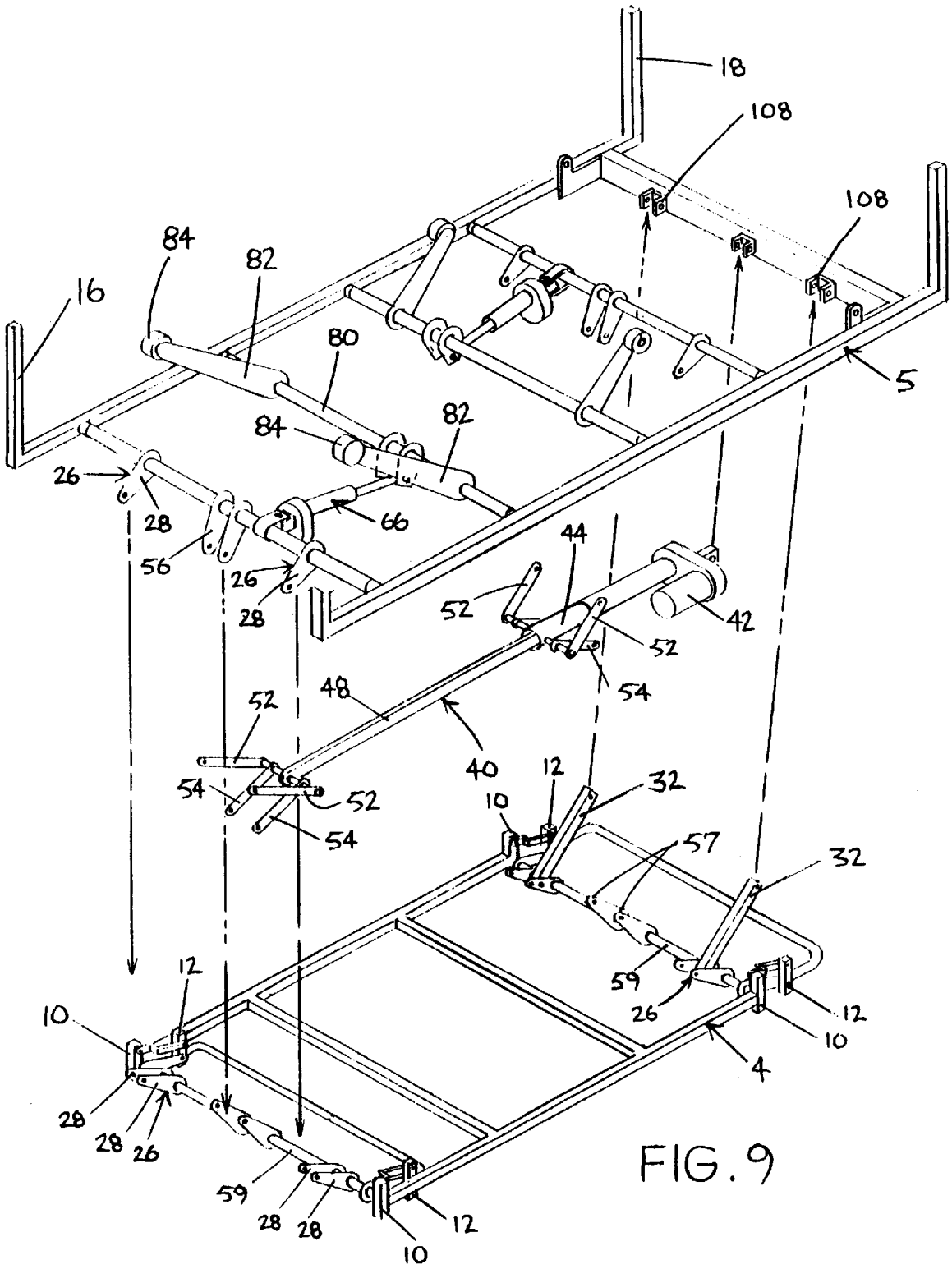
FIG. 9 is an exploded prospective view of the upper and lower frames and control means.

In FIG. 9, there is shown an exploded view of the lower frame 4 and upper frame 5. The same reference numerals are used in FIG. 9 for those components that are identical to the components shown in the previous figures. The purpose of the exploded view is to show how the various components interrelate. Also, for example, it can be seen that there are two long arms 82 and corresponding rollers 84 rigidly affixed to the rotatable tubular member 80. Similarly, there are two long arms 98 and corresponding rollers 100 rigidly affixed to the rotatable tubular member 96 of the mechanism 68. There are also two elongated members 28 on the lower frame 4 and one elongated member 28 on the upper frame 5 making up each of the four butterfly connectors 26 near the head 16 of the bed (not shown) and two butterfly connectors 26 near the foot 18 of the bed (not shown). Two supports 32 are pivotally connected between the rotatable tubular member 59 on the lower frame 4 and corresponding brackets 108 on the upper frame 5.

Figure 10:
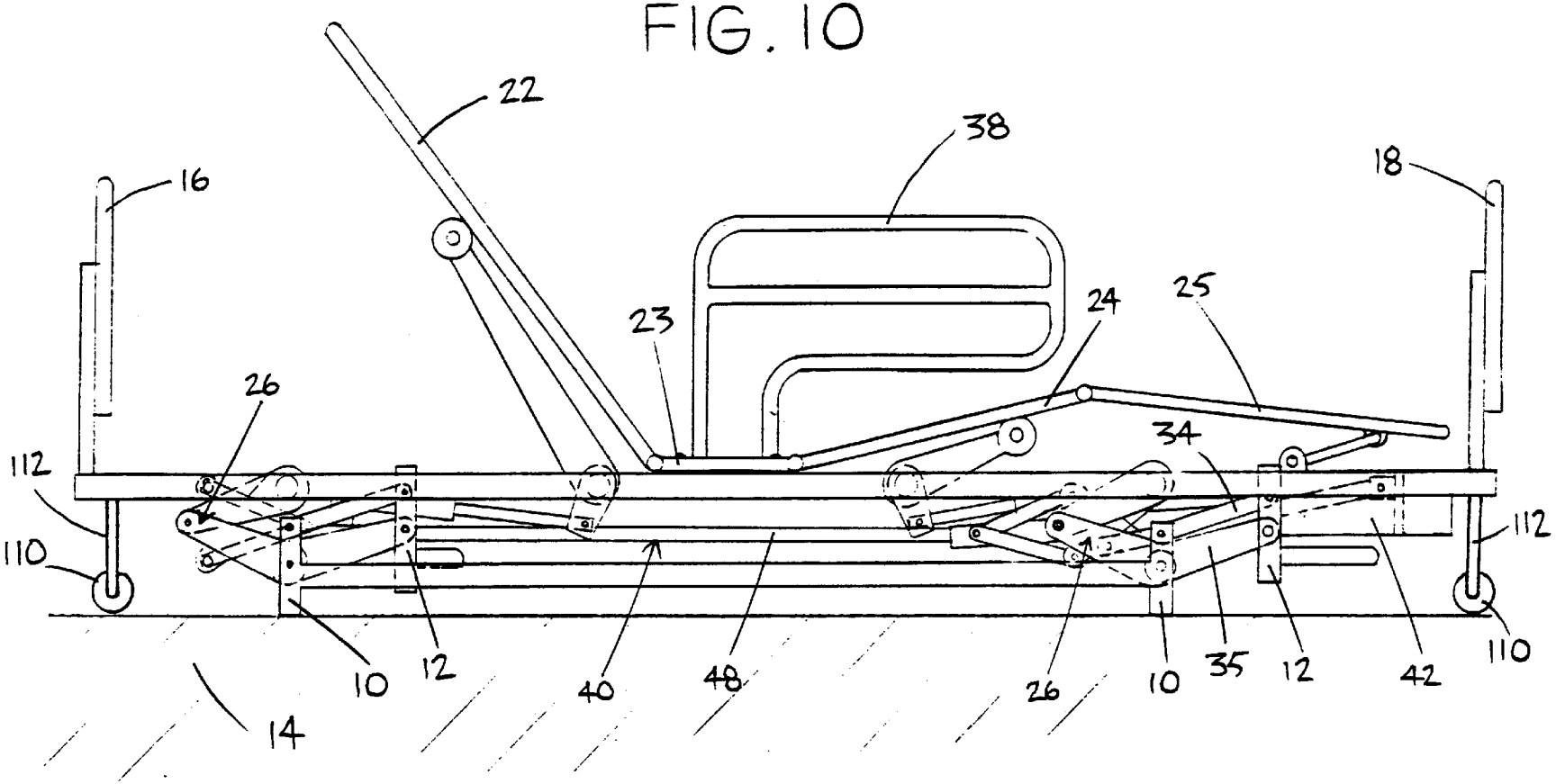
FIG. 10 is a side view of the bed in the lowermost position with wheels added.

In FIG. 10, there is shown an embodiment of the invention that is virtually identical to the embodiment shown in FIG. 3 except that the bed 2 has support wheels 110 mounted thereon. There are four wheels 110 on legs 112 (only two of which are shown) and the four legs with wheels comprise a third set of legs. The support wheels 110 rest on the supporting surface as the bed is lowered to the lowermost position and prevent the bed from reaching the lowermost position shown in FIG. 3. As the bed approaches the lowermost position, the first set of legs 6 lift off the supporting surface and the bed is supported solely by the wheels 110. This makes the bed mobile in that one position. When the bed is in any other position, either the first set of legs 6 or the second set of legs 8 is always on the supporting surface and the bed is immobilized. A bed with this third set of legs cannot be lowered to the same lowermost position as the wheels rest on the supporting surface just before the lowermost position is reached. In other words, the minimum height of the bed shown in FIG. 10 will be slightly greater than the minimum height of the bed shown in FIGS. 1, 2 and 3.

The bed could have an independent braking means (not shown) so that the bed can be immobilized when desired. The independent braking means could be applied to two or more of the wheels that are on the supporting surface simultaneously or they could be an independent braking means that places a "foot" on the supporting surface to anchor the bed in one position.

A standard size hospital bed or nursing home bed constructed in accordance with the present invention can have a height above the supporting surface to the upper frame from 7⅞" in the lowermost position to nearly 22" (e.g. 21.5") in the uppermost position. These distances are sometimes referred to as the mattress deck height. The ratio of the distance of the upper frame above the supporting surface from uppermost to lowermost is greater than 2.5. The actual height of the upper frame above the supporting surface will vary with the size of the bed. A bed ranging from a lowermost position of 7⅞" to an uppermost position of 21.5" has a ratio of 2.73. Variation within the scope of the attached claims will be readily apparent to those skilled in the art. For example, the use of two sets of legs in two continuous stages to greatly increase the change in height of a bed can be achieved in various ways that are different than the manner described herein. Beds of the present invention can be made relatively inexpensively and provide a safe, practical bed that is low enough to the floor to allow easy ingress and egress and to minimize injuries if a user should fall out of the bed. Beds of the present invention can be raised high enough to allow care givers to comfortably administer patients in the beds, to change the sheets and to use under bed tables and patient lifting devices.

I claim:

1. A height adjustable bed on a supporting surface, said bed comprising an upper frame with a first set of legs, said first set of legs being indirectly connected to a second set of legs and being moveable relative thereto, said first set of legs and said second set of legs each being moveable relative to said frame, control means being indirectly connected to said first set of legs to control movement of said first and second set of legs and of said upper frame, said first set of legs resting on said supporting surface when said upper frame is in a first stage position ranging from a lowermost position to a maximum intermediate position, said second set of legs resting on said supporting surface when said upper frame is in a second stage position ranging from said maximum intermediate position to an uppermost position.

2. A bed as claimed in claim 1 wherein said second set of legs is connected to pivot relative to said first set of legs.

3. A bed as claimed in claim 2 wherein said first set of legs is connected to said upper frame by butterfly connectors, said butterfly connectors being connected to said control means to expand and contract through a range of movement.

4. A bed as claimed in claim 3 wherein said first set of legs is pivotally connected to said second set of legs by connecting arms, said first set of legs having first legs and said second set of legs having second legs.

5. A bed as claimed in claim 4 wherein there are two connecting arms extending between each first leg and corresponding second leg, one of said connecting arms being rigidly connected to an end of the butterfly connector at each first leg.

6. A bed as claimed in claim 5 wherein the first set of legs is connected to a lower frame so that all of the first legs move in unison.

7. A bed as claimed in claim 6 wherein the second set of legs has second legs that are connected to corresponding first legs so that all of the second legs move relative to the first legs in unison.

8. A bed as claimed in claim 7 wherein said second set of legs pivots in one direction relative to said first set of legs as the upper frame is raised and the control means controls the butterfly connectors to expand said second set of legs then pivoting in an opposite direction relative to said first set of legs as said upper frame is lowered as the control means causes the butterfly connectors to contract.

9. A bed as claimed in claim 8 wherein the control means is powered by a reversible electric motor.

10. A bed as claimed in claim 9 wherein there are wheels on at least one of said first set of legs and said second set of legs.

11. A bed as claimed in any one of claims 1, 2 or 3 wherein there are four legs in each set of legs.

12. A bed as claimed in any one of claims 1, 2 or 3 wherein in the lowermost position of the upper frame, the upper frame is less than eight inches above the supporting surface and in the uppermost position of the upper frame, the upper frame is greater than twenty-one inches above the supporting surface.

13. A bed as claimed in any one of claims 1, 2 or 3 wherein a ratio of a distance of the supporting surface of the uppermost position to the lowermost position is greater than substantially 2.5.

14. A bed as claimed in any one of claims 1, 2 or 3 wherein a ratio of a distance of the supporting surface of the uppermost position to the lowermost position is at least 2.73.

15. A bed as claimed in any one of claims 1, 2 or 3 wherein there is a third set of legs with wheels thereon connected to optionally rest on said supporting surface in place of said first set of legs when said bed is substantially in a lowermost position.

16. A method of operating a height adjustable bed with a two stage continuous adjustment system, said bed having an upper frame connected indirectly to a first set of legs and to a second set of legs, with control means to control movement of said upper frame, said first set of legs and said second set of legs relative to one another, said first set of legs and said second set of legs each being movable relative to said frame, said method comprising commencing with the upper frame in a lowermost position with the first set of legs resting on the supporting surface, activating the control means to move the upper frame to a maximum intermediate position with the first set of legs and the second set of legs resting on the supporting surface, continuing to activate the control means to move the upper frame to the uppermost position with the second set of legs resting on the supporting surface.

* * * * *